US006304516B1

(12) United States Patent
LeBrun

(10) Patent No.: US 6,304,516 B1
(45) Date of Patent: Oct. 16, 2001

(54) TRANSDUCER SHELL ASSEMBLY FOR A BIMODAL TRANSDUCER

(75) Inventor: Scott W. LeBrun, Middletown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/638,531

(22) Filed: Aug. 14, 2000

(51) Int. Cl.[7] ..... H04R 23/00

(52) U.S. Cl. ..... 367/163

(58) Field of Search ..... 367/163, 165, 367/173, 174, 157; 310/337, 334, 324, 322

(56) References Cited

U.S. PATENT DOCUMENTS 5,268,879 * 12/1993 Flanagan ..... 367/174

* cited by examiner

*Primary Examiner*—Daniel T. Pihulic
(74) *Attorney, Agent, or Firm*—Michael C. McGowan; Prithvi C. Lall; Michael F. Oglo

(57) ABSTRACT

A transducer shell assembly and bimodal transducer are provided. The transducer shell assembly has a hollow split tube such that a gap extends along its length to define first and second opposing edges. A locking mechanism can lock the first and second opposing edges in a fixed relationship to fix the gap. In terms of the bimodal transducer, an electromechanical driver is coupled to an inside surface of the tube. A first frequency of operation is defined when the gap is fixed, while a second frequency of operation is defined when the first and second opposing edges are free to move with respect to one another.

18 Claims, 2 Drawing Sheets

TRANSDUCER SHELL ASSEMBLY FOR A BIMODAL TRANSDUCER

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates generally to underwater transducers, and more particularly to a transducer shell assembly, and a transducer using the shell assembly for bimodal operation at two distinct frequencies.

(2) Description of the Prior Art

A variety of mobile underwater transducer devices are used by the Navy. Some are used to simulate sonar characteristics of submarines for anti-submarine warfare (ASW) training, while others are deployed as sonar and torpedo countermeasures. In performing their various functions, these devices use underwater transducers to transmit and/or receive acoustic signals. Different types of transducers are used depending on the required frequency of operation. For example, split-ring transducers are used for low frequency operation below approximately 1 KHz. For higher frequency operation of approximately 2.5 KHz or higher, solid-ring (ceramic) transducers are used in order to support a breathing mode (i.e., radial expansion and contraction) of operation. Devices that give the user the option of high or low frequency operation are generally preferred. However, because of the vastly different construction of these two types of transducers, two separate transducer assemblies are used to support the different operation frequencies. This increases the overall weight and cost of underwater devices that utilize transducers.

SUMMARY OF THE INVENTION

Accordingly, it is an object of the present invention to provide an underwater transducer that can operate at either high or low frequencies.

Another object of the present invention to provide a bimodal transducer that is easily configured for either low frequency operation on the order of approximately 1 KHz or less or higher frequency operation on the order of approximately 2.5 KHz or higher.

Other objects and advantages of the present invention will become more obvious hereinafter in the specification and drawings.

In accordance with the present invention, a transducer shell assembly, and a bimodal transducer using the shell assembly are provided. The transducer shell assembly has a hollow split tube with a gap that extends along the tube's length to define first and second opposing edges. A locking mechanism is coupled to the tube for selectively locking the first and second opposing edges in a fixed relationship such that the gap is fixed. In terms of the bimodal transducer, an electromechanical driver is coupled to an inside surface of the tube. A first frequency of operation is defined when the first and second opposing edges are not in the fixed relationship. A second frequency of operation is defined when the first and second opposing edges are in the fixed relationship.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DESCRIPTION OF THE PREFERRED EMBODIMENT(S)

Figure 1:
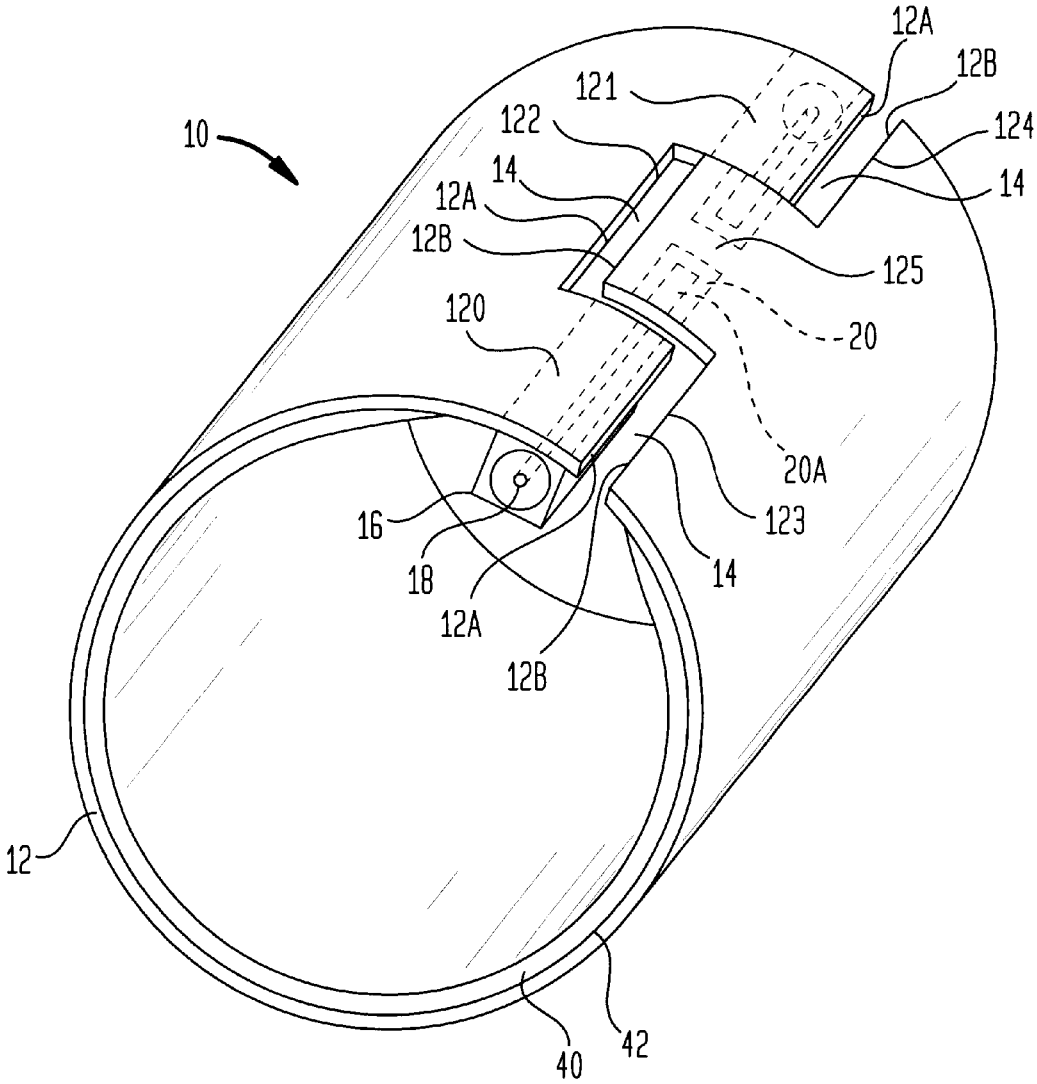
FIG. 1 is a perspective view of an embodiment of a bimodal transducer according to the present invention.

Referring now to the drawings, and more particularly to FIG. 1, an embodiment of a bimodal transducer is shown and referenced generally by numeral 10. Transducer 10 has a hollow tube forming an outer shell 12 made from a composite material suitable for use in a transducer device. The composite material can be selected from a variety of materials. A well known composite is a microballoon filled plastic material such as acrylonitrile-butadiene-styrene (ABS) or LEXAN polycarbonate available from General Electric Corporation. Shell 12 has a gap 14 formed along its length between edges 12A and 12B of shell 12. Shell 12 can be naturally biased to create/maintain gap 14. Absent a force to lock edges 12A and 12B into a fixed relationship with respect to one another, gap 14 will be free to change, i.e., edges 12A and 12B are free to move towards or away from one another when motivated to do so. In the illustrated embodiment, edge 12A is formed by fingers 120 and 121 positioned on either side of a notch 122. Conversely, edge 12B is formed by complementary notches 123 and 124 opposing fingers 120 and 121, respectively, and by a finger 125 positioned between notches 123 and 124 and opposing notch 122 in complementary fashion. The fingers and notches are sized to permit interlocking or nesting with one another while also allowing freedom of movement therebetween.

Figure 2:
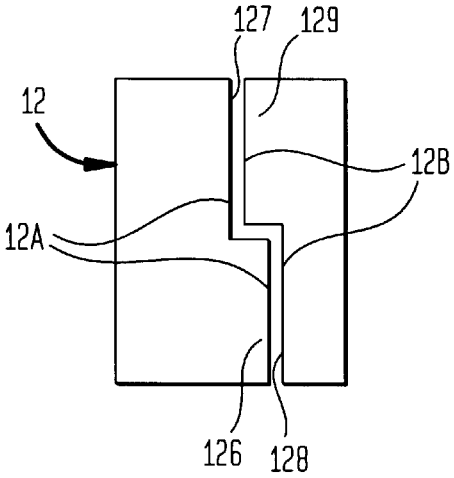
FIG. 2 is a plan view of another gap configuration in accordance with another embodiment of the present invention.
Figure 3:
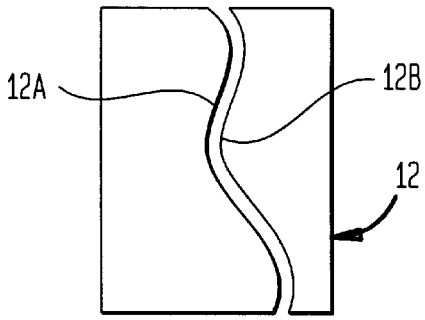
FIG. 3 is a plan view of a sinusoidal gap configuration.

It is to be understood that the particular number of fingers/notches or their shape is not a limitation of the present invention. For example, as illustrated in FIG. 2, edge 12A of shell 12 could be defined by a single finger 126 and adjacent notch 127, while edge 12B could be defined by a complementary notch 128 (opposing finger 126) and finger 129 (opposing notch 127). In still another embodiment, edges 12A and 12B are formed such that they define sinusoidal curves that nest with one another as illustrated in FIG. 3.

Regardless of the gap configuration, shell 12 is provided with means to lock edges 12A and 12B into a fixed relationship (i.e., fix gap 14) when it is desired for shell 12 to serve as a solid-ring type of transducer that will operate in a breathing mode. One way of locking edges 12A and 12B from movement with respect to one another is illustrated in FIG. 1. Specifically, a housing 16 mounted to an inside surface of shell 12 along edge 12A supports a pin 18 therein such that pin 18 can be moved axially. A pin receiver housing 20 is mounted to an inside surface of shell 12 along edge 12B such that a hole 20A in receiver housing 20 is aligned with pin 18.

Axial movement of pin 18 could be a manual operation or could be mechanized. For example, housing 16/pin 18 could be a solenoid-based assembly in which solenoid actuation causes axial movement of pin 18 toward receiver housing 20. Such solenoid-based pinning hardware is available commercially from IMC Magnetics Corporation, Tempe, Ariz. To assure that edges 12A and 12B are locked or fixed with respect to one another all along their lengths, additional ones of such locking assemblies can be provided as shown in FIG. 1 at the other end of transducer 10.

Figure 4:
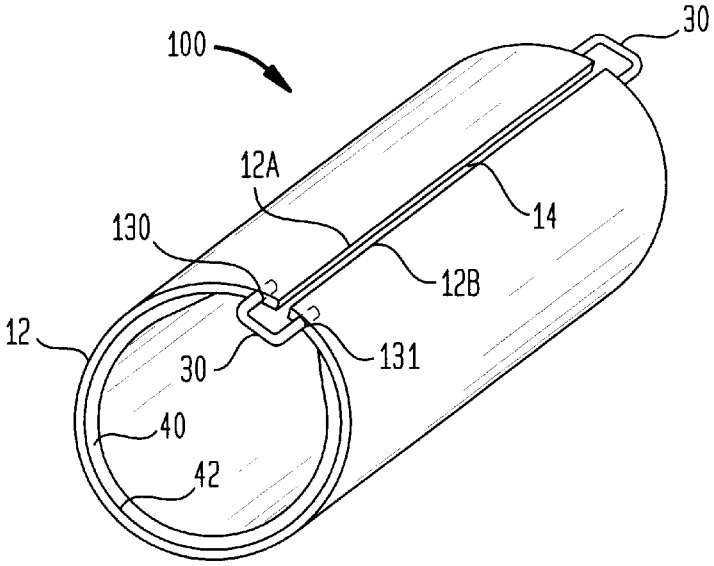
FIG. 4 is a perspective view of still another embodiment of a bimodal transducer according to the present invention.

Other types of locking mechanisms can be used without departing from the scope of the present invention. For example, as illustrated in FIG. 4, a transducer 100 uses a U-shaped pin 30 to lock edges 12A and 12B in their fixed relationship where no relative movement between edges 12A and 12B is permitted. (Note that edges 12A and 12B are simply straight edges in transducer 100.) Pin 30 could engage holes 130 and 131 formed in the edge of outer shell 12 with hole 130 being adjacent edge 12A and hole 131 being adjacent edge 12B. Another pin 30 could be used at the opposite end of transducer 100 to assure the fixed relationship when it is desired to operate transducer 100 as a solid-ring transducer.

Regardless of the type of locking assembly used to maintain edges 12A and 12B in their locked or fixed relationship, the bimodal transducer of the present invention has a split-ring electromechanical driver (e.g., a piezoelectric ceramic such as lead zirconate titanate or PZT) coupled to the interior surface of shell 12. For example, in the FIG. 1 embodiment, a split-ring driver 40 is coupled to the interior surface of outer shell 12 such that gap 14 is maintained when transducer 10 is to be operated as a split-ring transducer.

A pliant urethane window or sheet 42 is typically disposed between driver 40 and shell 12 to flexibly couple driver 40 to shell 12. If the adhesive properties of urethane window 42 are insufficient to maintain the necessary bond, an adhesive (not shown) can be used in combination with urethane window 42 to adhere driver 40 to shell 12. As is well known in the art, the inside and outside surfaces of driver 40 would be electrically coupled to a source of electrical energy (not shown).

In operation, when the present invention is to be operated as a split-ring transducer, the locking mechanism is disengaged so that gap 14 is free to change as edges 12A and 12B can move towards/away from one another. For example, for transducer 10 illustrated in FIG. 1, pin 18 is withdrawn into housing 16 either manually or by solenoid deactivation as described above. When the present invention is to be operated as a solid-ring transducer, edges 12A and 12B are locked into the fixed relationship. For transducer 10, pin 18 is moved axially (manually or by solenoid activation) to extend from housing 16 to engage hole 20A of receiver housing 20 as described above.

The advantages of the present invention are numerous. A simple transducer shell assembly is easily configured as a bimodal transducer capable of operation as either a (low frequency) split-ring transducer or a (higher frequency) solid-ring breathing mode transducer. As a result of the present invention, weight and costs for underwater transducer devices can be lowered.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A transducer shell assembly, comprising:

a hollow split tube having a gap extending along its length to define first and second opposing edges; and means coupled to said tube for selectively maintaining said first and second opposing edges in one of a fixed relationship and a free relationship, wherein said first and second opposing edges are restricted from movement towards and away from one another in said fixed relationship, and wherein said first and second opposing edges are free to move towards and away from one another in said free relationship.

2. A transducer shell assembly as in claim 1 wherein said first and second opposing edges nest with one another.

3. A transducer shell assembly as in claim 1 wherein said first and second opposing edges define interlocking fingers.

4. A transducer shell assembly as in claim 1 wherein said fixed relationship is maintained by at least one mechanical assembly.

5. A transducer shell assembly as in claim 4 wherein said mechanical assembly comprises a pin engaging said tube adjacent each of said first and second opposing edges.

6. A transducer shell assembly as in claim 5 wherein said pin engages an end of said tube.

7. A transducer shell assembly as in claim 4 wherein said mechanical assembly comprises:

a housing coupled to an inside portion of said tube in proximity to said first edge;

a pin supported within said housing for axial movement; and a pin receiver coupled to an inside portion of said tube in proximity to said second edge at a position that is axially aligned with said pin, wherein said axial movement of said pin towards said pin receiver causes to said pin to engage said pin receiver to create and maintain said fixed relationship.

8. A transducer shell assembly as in claim 7 further comprising a solenoid coupled to said pin, wherein said axial movement of said pin occurs when said solenoid is activated.

9. A transducer shell assembly as in claim 1 wherein said tube comprises a composite material capable of flexing in a radial direction of said tube when said first and second opposing edges are in said fixed relationship.

10. A bimodal transducer, comprising:

a hollow split tube having a gap extending along its length to define first and second opposing edges;

means coupled to said tube for selectively locking said first and second opposing edges in a fixed relationship wherein said gap is fixed and wherein, when not in said fixed relationship, said first and second opposing edges are free to move towards and away from one another; and an electromechanical driver coupled to an inside surface of said tube, wherein a first frequency of operation is defined when said first and second opposing edges are not in said fixed relationship and a second frequency of operation is defined when said first and second opposing edges are in said fixed relationship.

11. A bimodal transducer as in claim 10 wherein said first and second opposing edges nest with one another.

12. A bimodal transducer as in claim 10 wherein said first and second opposing edges define interlocking fingers.

13. A bimodal transducer as in claim 10 wherein said means comprises at least one mechanical assembly.

14. A bimodal transducer as in claim 13 wherein said mechanical assembly comprises a pin engaging said tube adjacent each of said first and second opposing edges.

15. A bimodal transducer as in claim 14 wherein said pin engages an end of said tube.

16. A bimodal transducer as in claim 13 wherein said mechanical assembly comprises:

a housing coupled to an inside portion of said tube in proximity to said first edge;

a pin supported within said housing for axial movement; and a pin receiver coupled to an inside portion of said tube in proximity to said second edge at a position that is axially aligned with said pin, wherein said axial movement of said pin towards said pin receiver causes to said pin to engage said pin receiver to lock said first and second opposing edges in said fixed relationship.

17. A bimodal transducer as in claim 16 further comprising a solenoid coupled to said pin, wherein said axial movement of said pin occurs when said solenoid is activated.

18. A bimodal transducer as in claim 10 wherein said tube comprises a composite material capable of flexing in a radial direction of said tube when said first and second opposing edges are locked in said fixed relationship.

* * * * *